US009186727B2

(12) United States Patent
Takahashi et al.

(10) Patent No.: US 9,186,727 B2
(45) Date of Patent: Nov. 17, 2015

(54) METAL PARTICLE

(75) Inventors: Tomoyuki Takahashi, Niigata (JP); Akito Yoshii, Niigata (JP)

(73) Assignee: NAMICS CORPORATION, Niigata-Shi, Niigata (JP)

( * ) Notice: Subject to any disclaimer, the term of this patent is extended or adjusted under 35 U.S.C. 154(b) by 158 days.

(21) Appl. No.: 13/884,013

(22) PCT Filed: Nov. 4, 2011

(86) PCT No.: PCT/JP2011/075508
§ 371 (c)(1),
(2), (4) Date: May 8, 2013

(87) PCT Pub. No.: WO2012/063747
PCT Pub. Date: May 18, 2012

(65) Prior Publication Data

US 2013/0221287 A1 Aug. 29, 2013

(30) Foreign Application Priority Data

Nov. 8, 2010 (JP) ..... 2010-250251

(51) Int. Cl.
*B22F 9/24* (2006.01)
*B22F 9/18* (2006.01)
(Continued)

(52) U.S. Cl.
CPC ..... *B22F 9/24* (2013.01); *B22F 1/0011* (2013.01); *B22F 1/0014* (2013.01); *B22F 3/11* (2013.01);
(Continued)

(58) Field of Classification Search
CPC ..... B22F 1/0011; B22F 1/0014; B22F 3/11; B22F 9/18; B22F 9/24; H01B 1/02; H01B 1/22
USPC ..... 252/514
See application file for complete search history.

(56) References Cited

U.S. PATENT DOCUMENTS 3,407,057 A * 10/1968 Timmons ..... 420/429
6,019,813 A 2/2000 Gorge et al.
(Continued)

FOREIGN PATENT DOCUMENTS

CN 101579746 A 11/2009
JP 53-21068 A 2/1978
(Continued)

OTHER PUBLICATIONS

Won et al. "Preparation of porous silver particles using ammonium formate and its formation mechanism" Chemical engineering journal 156 (2010) 459-464 (Jan. 15, 2010).*
(Continued)

*Primary Examiner* — Peter F Godenschwager
*Assistant Examiner* — Andrew J Oyer
(74) *Attorney, Agent, or Firm* — Holtz, Holtz, Goodman & Chick PC

(57) ABSTRACT

A metal particle which is a non-nucleated, spherical porous material having continuous open pores, and which is formed from dendritic crystals which have grown uniformly outward from the center without requiring a nucleating agent. The metal particle is unlikely to suffer bonding or aggregation of the metal particles and exhibits excellent dispersibility. When the metal particle is used in a conductive composition, such as a conductive paste, a cured product having satisfactory conduction properties can be obtained at a relatively low temperature, making it possible to easily control the specific gravity or resistance.

10 Claims, 8 Drawing Sheets

(51) Int. Cl.

| | |
|---|---|
| ***B22F 1/00*** | (2006.01) |
| ***B22F 3/11*** | (2006.01) |
| ***C22C 5/06*** | (2006.01) |
| ***C22C 5/02*** | (2006.01) |
| ***C22C 1/02*** | (2006.01) |
| ***C22C 9/00*** | (2006.01) |
| ***C22C 5/04*** | (2006.01) |
| ***C22C 19/03*** | (2006.01) |
| ***H01B 1/02*** | (2006.01) |
| ***H01B 1/22*** | (2006.01) |

(52) U.S. Cl.

CPC ... *B22F 9/18* (2013.01); *C22C 1/02* (2013.01); *C22C 5/02* (2013.01); *C22C 5/04* (2013.01); *C22C 5/06* (2013.01); *C22C 9/00* (2013.01); *C22C 19/03* (2013.01); *H01B 1/02* (2013.01); *H01B 1/22* (2013.01); *Y10T 428/12* (2015.01)

(56) References Cited

U.S. PATENT DOCUMENTS

| | | | | |
|---|---|---|---|---|
| 7,799,408 | B2 * | 9/2010 | Hori et al. | 428/203 |
| 8,007,690 | B2 * | 8/2011 | Yamakawa et al. | 252/512 |
| 8,231,704 | B2 | 7/2012 | Irizarry | |
| 2005/0279970 | A1 * | 12/2005 | Ogi et al. | 252/514 |
| 2006/0204395 | A1 | 9/2006 | Johnson, Jr. | |
| 2009/0066193 | A1 * | 3/2009 | Glicksman et al. | 310/363 |
| 2009/0095131 | A1 | 4/2009 | Johnson, Jr. | |
| 2009/0098010 | A1 | 4/2009 | Johnson, Jr. | |
| 2009/0116995 | A1 | 5/2009 | Johnson, Jr. | |
| 2009/0116998 | A1 * | 5/2009 | Fujimoto et al. | 420/501 |
| 2010/0279116 | A1 * | 11/2010 | Irizarry | 428/402 |
| 2012/0049133 | A1 * | 3/2012 | Irizarry | 252/514 |

FOREIGN PATENT DOCUMENTS

| | | | |
|---|---|---|---|
| JP | 08-311659 | A | 11/1996 |
| JP | 11-505884 | A | 5/1999 |
| JP | 2001-107101 | A | 4/2001 |
| JP | 2004-149903 | A | 5/2004 |
| JP | 2005-146387 | A | 6/2005 |
| JP | 2006-002228 | A | 1/2006 |
| JP | 2006-97086 | A | 4/2006 |
| JP | 2006-152344 | A | 6/2006 |
| JP | 2006-183092 | A | 7/2006 |
| JP | 2006-193795 | A | 7/2006 |
| JP | 2007-138249 | A | 6/2007 |
| JP | 2007-138250 | A | 6/2007 |
| JP | 2007-204795 | A | 8/2007 |
| JP | 2008-115439 | A | 5/2008 |
| JP | 2009-13449 | A | 1/2009 |
| JP | 2009-144196 | A | 7/2009 |
| JP | 2009-527640 | A | 7/2009 |
| WO | WO 2009/096569 | A1 | 8/2009 |
| WO | 2010127343 | A1 | 11/2010 |
| WO | 2010127349 | A1 | 11/2010 |

OTHER PUBLICATIONS

International Search Report mailed Jan. 24, 2012 for PCT/JP2011/075508.

Chinese Office Action dated Jul. 24, 2014 in counterpart Chinese Application No. 201180053632.9.

Zhang, et al., "Production of Metallic Porous Spherical Silver Powders", Rare Metal Materials and Engineering; vol. 38, No. 7, Jul. 2009, pp. 1-8. 1.

Japanese Office Action (and partial English translation thereof) dated Aug. 6, 2015, issued in counterpart Japanese Application No. 2012-542897.

* cited by examiner

| | Measured value | | Magnification: 10,000 | Magnification: 5,000 | Magnification: 2,000 | Magnification: 20,000 |
|---|---|---|---|---|---|---|
| Example 2 | BET ($m^2/g$) | 5.88 |  |  |  |  |
| | Tap (g/cc) | 1.96 | | | | |
| | K Value | 14.5 | | | | |
| | Particle size distribution ($\mu m$) | | | | | |
| | D10 | 0.47 | | | | |
| | D50 | 0.67 | | | | |
| | D90 | 0.99 | | | | |
| Example 3 | BET ($m^2/g$) | 3.19 |  |  |  | |
| | Tap (g/cc) | 2.82 | | | | |
| | K Value | 5.62 | | | | |
| | Particle size distribution ($\mu m$) | | | | | |
| | D10 | 2.33 | | | | |
| | D50 | 3.32 | | | | |
| | D90 | 4.29 | | | | |
| Example 4 | BET ($m^2/g$) | 2.09 |  |  |  | |
| | Tap (g/cc) | 4.48 | | | | |
| | K Value | 3.43 | | | | |
| | Particle size distribution ($\mu m$) | | | | | |
| | D10 | 5.84 | | | | |
| | D50 | 7.97 | | | | |
| | D90 | 10.17 | | | | |

METAL PARTICLE

CROSS-REFERENCE TO RELATED APPLICATION

This application is a United States national phase application of International Application PCT/JP2011/075508 filed Nov. 4, 2011.

FIELD OF THE INVENTION

The present invention relates to a metal particle which is a non-nucleated, spherical porous material having continuous open pores, and a method for producing the same. More particularly, the present invention is concerned with a metal particle formed from dendritic crystals which have grown uniformly outward from the center without requiring a nucleating agent so that the metal particle has a fine uneven structure in the spherical surface, and a method for producing the same.

BACKGROUND ART

Conventionally, there has been known a fine silver powder obtained by allowing dendritic crystals of silver or copper to grow on an electrode plate by an electrolytic method (patent document 1). There have also been known a metal particle obtained by allowing dendritic crystals of silver or copper to grow from a nucleating agent as a center by an electroless method so that the metal particle has radially extending protrusions and depressions between the protrusions (patent document 2), and a metal particle having a plurality of protrusions which protrude like a chestnut bur (patent document 3). Further, a dendritic silver powder obtained by an electroless wet process has been known (patent document 4).

PRIOR ART REFERENCES

Patent Documents

Patent document 1: Japanese Unexamined Patent Publication No. 2007-204795

Patent document 2: Japanese Unexamined Patent Publication No. 2004-149903

Patent document 3: Japanese Unexamined Patent Publication No. 2009-144196

Patent document 4: Japanese Unexamined Patent Publication No. 2005-146387

SUMMARY OF THE INVENTION

Problems to be Solved by the Invention

However, the above-mentioned fine silver powder described in patent document 1 is obtained by a method in which silver particles deposited on an electrode plate by an electrolytic method are removed from the electrode plate by scratching and further subjected to electrolysis to obtain a dendritic silver powder. Therefore, the dendrite growth is relatively non-uniform, making it difficult to obtain a true spherical fine silver powder. In addition, the resultant silver powder has a small tap density, and therefore it is difficult to form a uniform sintered film from the silver powder.

The metal particle described in patent document 2 is formed from dendritic crystals which have grown from a nucleating agent as a center, and hence inevitably requires a nucleating agent, and the obtained metal particle has a relatively sparse structure such that the content of voids due to depressions is preferably more than 40% by volume, based on the volume of the sphere (100% by volume).

The metal particle described in patent document 3 is also, formed from dendritic crystals which have grown from a nucleating agent as a center, and hence inevitably requires a nucleating agent, and the obtained metal particle has a number of protrusions in a chestnut bur form, and therefore the protrusions in a chestnut bur form are likely to tangle, causing aggregation of the particles.

The silver powder described in patent document 4 requires no nucleating agent; however, the powder has dendritic portions formed from needle-like crystals which have thinly grown, and therefore the thin and needle-like dendritic portions are likely to tangle, causing aggregation of the silver powder. Further, the silver powder has the dendritic portions formed from needle-like crystals which have thinly grown, and therefore has a relatively sparse structure such that the tap density is as small as 0.4 to 0.7 g/cm$^3$.

An object of the present invention is to provide a metal particle which is advantageous not only in that the metal particle is unlikely to suffer bonding or aggregation of the metal particles and exhibits excellent dispersibility, but also in that the metal particle has an appropriate tap density and a large specific surface area and the density is large relative to the specific surface area, and a method for producing the same. An object of the present invention is to provide a metal particle which is advantageous in that when used in a conductive composition, such as a conductive paste, the composition can be cured at a relatively low temperature (for example, at 120 to 200° C.), and the obtained cured product can exhibit satisfactory conduction properties, making it possible to easily control the specific gravity or resistance, and a method for producing the same.

Means to Solve the Problems

The present invention for solving the above problems is a metal particle having a specific shape, which is advantageous not only in that the metal particle is unlikely to suffer bonding or aggregation of the metal particles and exhibits excellent dispersibility, but also in that the metal particle has an appropriate tap density and a large specific surface area and the density is large relative to the specific surface area. When the metal particle is used in a conductive composition, such as a conductive paste, the composition can be cured at a relatively low temperature (for example, at 120 to 200° C.), and the obtained cured product can exhibit satisfactory conduction properties, making it possible to easily control the specific gravity or resistance.

Accordingly, the present invention is directed to a metal particle which is a non-nucleated, spherical porous material having continuous open pores.

The present invention is directed to the metal particle which has a volume cumulative particle diameter $D_{50}$ of 0.1 to 15 μm as measured by a particle size distribution measurement method using image analysis, a tap density of 1 to 6 g/cm$^3$, or a specific surface area of 0.25 to 8 m$^2$/g as measured by a BET method.

The present invention is directed to the metal particle, wherein the value K determined from a specific surface area SS and a specific surface area BS and represented by the general formula (2) below satisfies the relationship: $3 \leq K \leq 72$, wherein the specific surface area SS is represented by the formula (1) below wherein particle diameter d is a volume cumulative particle diameter $D_{50}$ as measured by a particle size distribution measurement method using image analysis and ρ is a theoretical density of the metal particle, and the specific surface area BS is a specific surface area as measured by a BET method:

$$SS=6/\rho d \quad (1)$$

$$(SS/BS)\times 100=K \quad (2)$$

The present invention is directed to the metal particle, wherein the region SA of void portions obtained by subjecting the image of the cross-section of the metal particle taken by means of a scanning electron microscope, magnified 20,000 times, to image processing satisfies the relationship: $20 \leq SA \leq 40$.

The present invention is directed to the metal particle, wherein, in the image of the metal particle taken by means of a scanning electron microscope, magnified 20,000 times, the morphology of the appearance of the metal particle has an aegagropila form. The present invention is directed to the metal particle, wherein, in the image of the metal particle taken by means of a scanning electron microscope, magnified 10,000 times, the morphology of the cross-section of the metal particle has a non-nucleated coral form.

The present invention is directed to the metal particle, wherein the cross-sectional structure of the metal particle taken by means of a scanning electron microscope, magnified 20,000 times, has a structure shown in FIG. 1.

The present invention is directed to the metal particle which is selected from the group consisting, of silver, copper, gold, nickel, and palladium.

Further, the present invention is directed to a conductive composition comprising the metal particle which is a non-nucleated, spherical porous material having continuous open pores, and a resin, a conductor comprising a cured product obtained by curing the conductive composition, and an electronic part having the conductor.

The present invention is directed to a method for producing a metal particle, which comprises the steps of: mixing a metal salt and a polycarboxylic acid in a liquid phase; adding a reducing agent to the resultant mixture to deposit metal particles; and drying the deposited metal particles.

The present invention is directed to the method for producing a metal particle, wherein the temperature for the mixing step and the depositing step is 10 to 30° C., and the drying temperature is 0 to 80° C.

The present invention is directed to the method for producing a metal particle, wherein the metal constituting the metal salt is selected from the group consisting of silver, copper, gold, nickel, and palladium, or wherein the metal salt is selected from the group consisting of a nitrate, a sulfate, a carbonate, a chloride.

The present invention is directed to the method for producing a metal particle, wherein the polycarboxylic acid is at least one polycarboxylic acid selected from the group consisting of citric acid, malic acid, maleic acid, and malonic acid. The present invention is directed to the method for producing a metal particle, wherein the reducing agent is ascorbic acid or an isomer thereof.

Further, the present invention is directed to a metal particle obtained by the above-mentioned the method for producing a metal particle.

Effect of the Invention

The present invention is a metal particle which is a non-nucleated, substantially true spherical porous material having continuous open pores, and comprises a metal particle formed from dendritic crystals which have grown uniformly outward from the center without requiring a nucleating agent. In the present invention, the metal particle has dendritic portions formed from crystals which have radially grown so that the metal particle has a fine uneven structure in the spherical surface, and therefore is unlikely to suffer bonding or aggregation of the metal particles and exhibits excellent dispersibility, and has an appropriate tap density and a large specific surface area, and further the density is large relative to the specific surface area. In the present invention, there can be provided a metal particle which is advantageous in that when the metal particle of the present invention is used in a conductive composition, such as a conductive paste, the composition can be cured at a relatively low temperature (for example, at 120 to 200° C.), and a cured product having satisfactory conduction properties can be obtained, making it possible to easily control the specific gravity or resistance, and a method for producing the same.

Further, in the present invention, a metal particle which is a non-nucleated, spherical porous material having continuous open pores can be obtained by mixing a metal salt and a polycarboxylic acid in a liquid phase to effect a reaction, and then adding a reducing agent to the resultant mixture, and thus there can be obtained a metal particle formed from dendritic crystals which have grown uniformly outward from the center without requiring a nucleating agent so that the metal particle has a fine uneven structure in the spherical surface.

MODE FOR CARRYING OUT THE INVENTION

Hereinbelow, a mode for carrying out the present invention will be described in detail with reference to the accompanying drawings.

Figure 1:
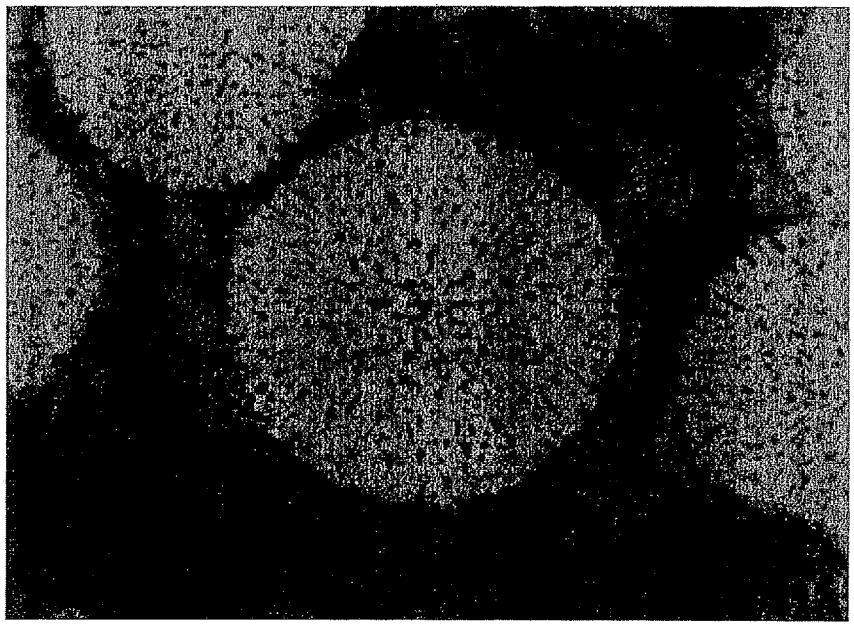
FIG. 1 A SEM photomicrograph of the cross-section of the metal (silver) particle of the present invention, magnified 20,000 times.

FIG. 1 shows an image of the cross-section of the metal particle of the present invention taken by means of a scanning electron microscope (SEM), magnified 20,000 times. The cross-sectional structure of the metal particle of the present invention has a structure shown in FIG. 1.

As shown in FIG. 1, the metal particle of the present invention is a non-nucleated, spherical porous material having continuous open pores, and comprises a metal particle formed from dendritic crystals which have grown uniformly outward from the center without requiring a nucleating agent. The metal particle of the present invention does not have dendritic portions formed from needle-like crystals which have thinly grown but has dendritic portions formed from crystals which have radially grown so that the metal particle has a fine uneven structure in the spherical surface. In the present specification, the term "non-nucleated" means that a nucleating agent separately added for causing nucleation is not present.

Figure 2:
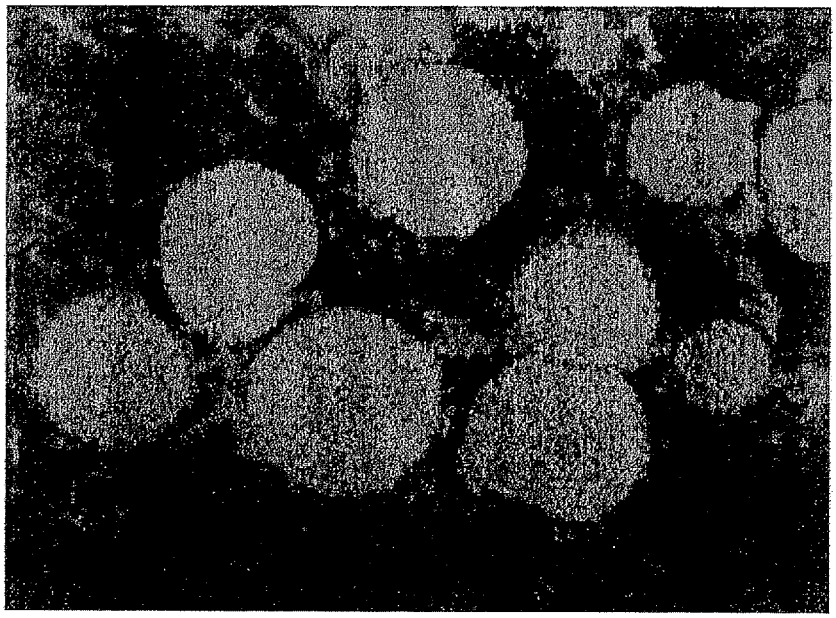
FIG. 2 A SEM photomicrograph of the cross-section of the metal (silver) particle of the present invention, magnified 10,000 times.

FIG. 2 is a SEM photomicrograph of the cross-section of the metal particle of the present invention taken by means of a scanning electron microscope, magnified 10,000 times. As shown in FIG. 2, the morphology of the cross-section of the metal particle of the present invention has a non-nucleated coral form.

Figure 3:
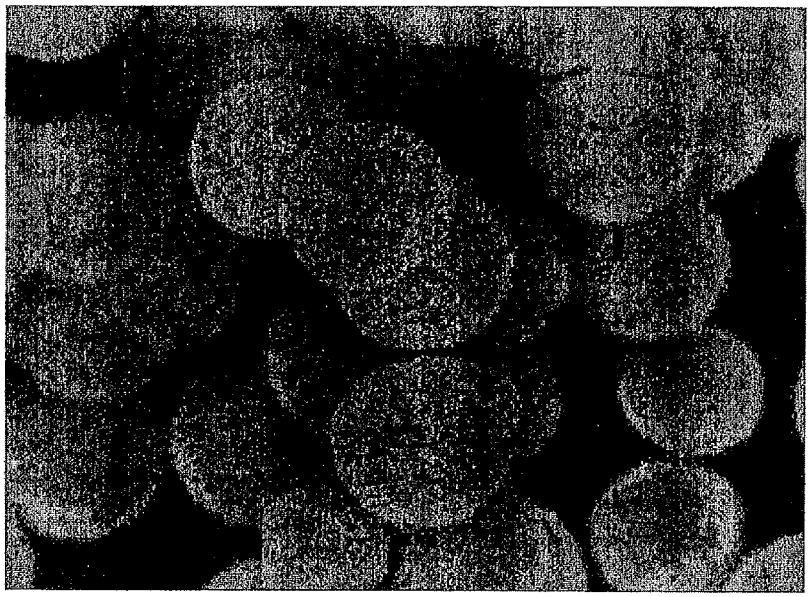
FIG. 3 A SEM photomicrograph of the metal (silver) particle of the present invention magnified 10,000 times.
Figure 4:
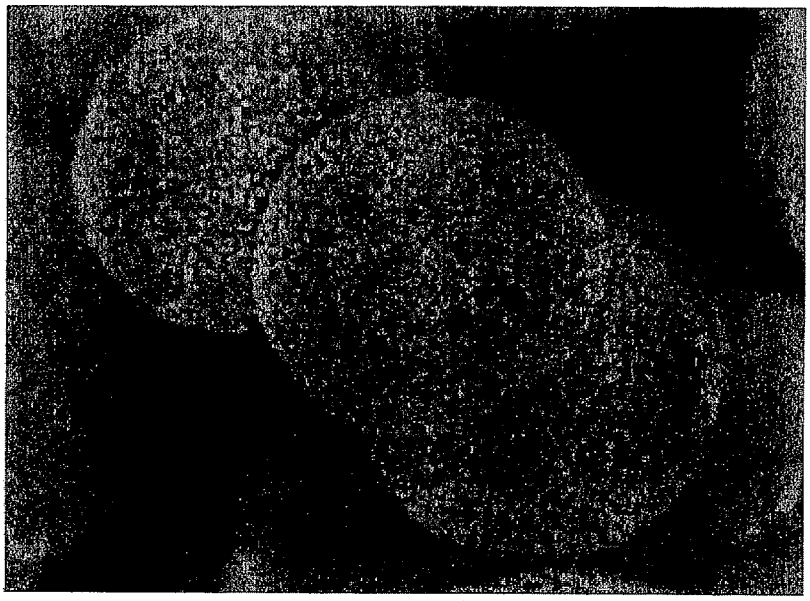
FIG. 4 A SEM photomicrograph of the metal (silver) particle of the present invention magnified 20.000 times.
Figure 5:
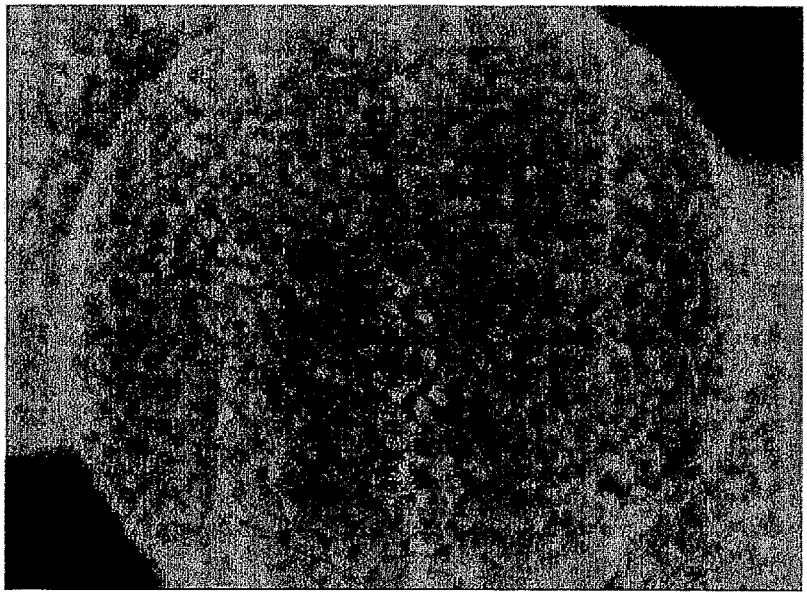
FIG. 5 A SEM photomicrograph of the metal (silver) particle of the present invention magnified 40.000 times.

FIGS. 3, 4, and 5 are images of the metal particle of the present invention taken by means of a scanning electron microscope (SEM), magnified 10,000 times, 20,000 times, and 40,000 times, respectively. As shown in FIG. 4, the morphology of the appearance of the metal particle of the present invention has an aegagropila form.

As shown in FIGS. 3, 4, and 5, the metal particle is substantially true spherical and has dendritic portions formed from crystals which have radially grown substantially uniformly, and therefore has fine unevenness in the spherical surface. The unevenness in the spherical surface of the metal particle of the present invention has a fine structure comprising protrusions and spaces (depressions) between the protrusions.

Figure 6:
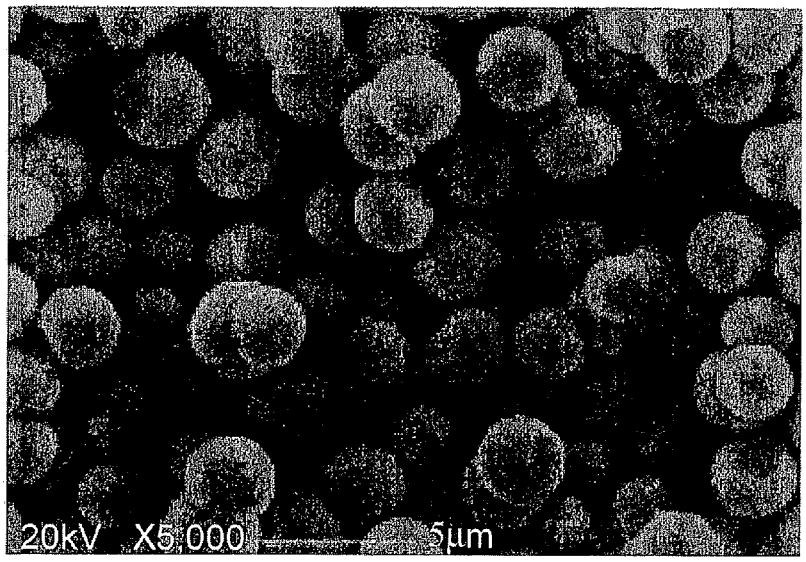
FIG. 6 A SEM photomicrograph of the metal (silver) particle of the present invention magnified 5.000 times.
Figure 7:
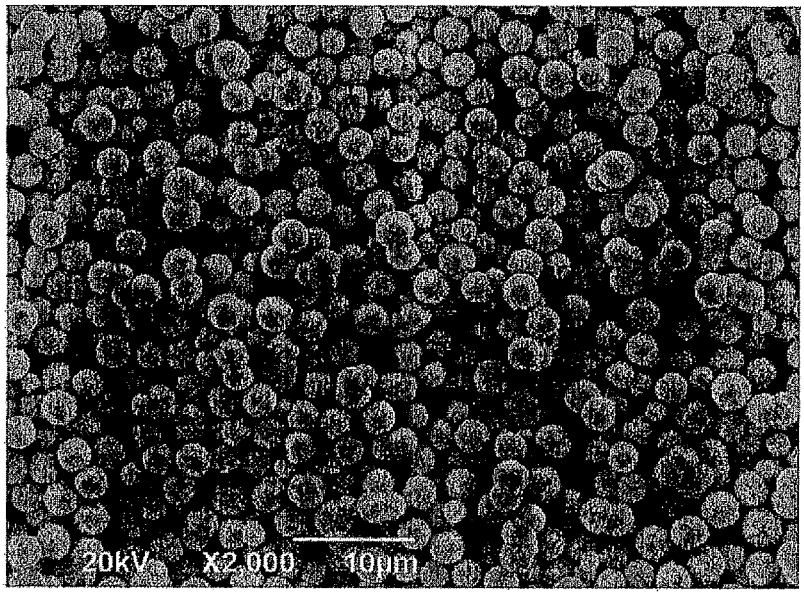
FIG. 7 SEM photomicrograph of the metal (silver) particle of the present invention magnified 2,000 times.

FIGS. 6 and 7 are images of the metal particle of the present invention taken by means of a scanning electron microscope (SEM), magnified 5,000 times and 2,000 times, respectively. As shown in FIGS. 6 and 7, the metal particle of the present invention is unlikely to suffer bonding or aggregation of the metal particles, and can be easily dispersed and hence exhibits excellent dispersibility. The reason why the metal particle is unlikely to suffer bonding or aggregation of the metal particles is presumed that the metal particle of the present invention has dendritic portions formed from crystals which have densely and uniformly grown, and thus has a fine uneven form such that the uneven structures in the spherical surfaces do not mesh with each other, so that the metal particle is unlikely to suffer bonding or aggregation of the metal particles. Further, the crystals in the metal particle have radially grown outward from the center, and the metal particles are prevented from being bonded together, and a repelling stress is generated during the crystal growth, so that the bonding force between the metal particles becomes weak.

As mentioned above, the metal particle of the present invention is unlikely to suffer bonding or aggregation of the metal particles, and therefore the metal particle has excellent dispersibility in a medium, such as a resin, and further the dendritic portions suffer no breakage upon dispersing the metal particle, and it is expected that when the metal particle is dispersed in, e.g., a resin and used in the form of a conductive composition, such as a conductive paste, it is possible to easily control the specific gravity or resistance. Further, the metal particle of the present invention has a fine uneven portion formed in the spherical surface of the metal particle which is substantially true spherical. By virtue of having the fine uneven structure, the metal particle is fused at a low temperature (for example, at 80 to 100° C.). For this reason, it is expected that when a conductive composition, such as a conductive paste, using the metal particle of the present invention is heated at a relatively low temperature (for example, at 120 to 200° C.), the metal particle is fused, exhibiting excellent conduction properties. On the other hand, a conventional dendritic metal particle has dendritic portions formed from pointed needle-like crystals which have grown in a relatively sparse state. Therefore, the pointed needle-like dendritic portions are likely to tangle and to be strongly fused together, causing aggregation of the particles, so that the dispersibility of the particle in, e.g., a resin becomes poor. Further, it is expected that the pointed needle-like portions are likely to be broken upon mixing into a resin, making it difficult to control the specific gravity or resistance.

The metal particle of the present invention preferably has a volume cumulative particle diameter $D_{50}$ of 0.1 to 15 μm, more preferably 0.3 to 10 μm, further preferably 0.5 to 9 μm, as measured by a particle size distribution measurement method using image analysis.

In the present invention, the particle size distribution measurement method using image analysis is a method in which an image of the metal particle taken by means of a scanning electron microscope (SEM) at a predetermined magnification is subjected to image processing and particle size distribution with respect to the resultant image is measured using a particle size distribution image analysis system (for example, trade name: Mac-VIEW ver 1.00, manufactured by Mountech Co. Ltd.), and the volume cumulative particle diameter $D_{50}$ indicates a particle diameter at volume accumulation 50% as measured by a particle size distribution measurement method using image analysis.

Further, the metal particle of the present invention preferably has a volume cumulative particle diameter $D_{90}$ of 0.5 to 12 μm, more preferably 0.99 to 11 μm, as measured by a particle size distribution measurement method using image analysis, and preferably has a volume cumulative particle diameter $D_{10}$ of 0.45 to 7.8 μm, more preferably 0.47 to 7.5 μm, as measured by a particle size distribution measurement method using image analysis. The volume cumulative particle diameters $D_{90}$, $D_{10}$ indicate particle diameters at volume accumulations 90% and 10%, respectively, as measured by a particle size distribution measurement method using image analysis.

The ratio of $D_{90}$ to $D_{50}$ ($D_{90}/D_{50}$), as measured by a particle size distribution measurement method using image analysis, is preferably 1.2 to 1.98, more preferably 1.22 to 1.65. Further, the ratio of $D_{50}$ to $D_{10}$ ($D_{50}/D_{10}$), as measured by a particle size distribution measurement method using image analysis, is preferably 1.05 to 1.5 more preferably 1.06 to 1.45. Thus, the metal particle of the present invention is very small in the dispersion of the particle diameter and has a substantially uniform particle diameter and a sharp particle size distribution and hence exhibits excellent form retention and excellent dispersibility.

The metal particle of the present invention preferably has a tap density of 1 to 6 g/cm$^3$, more preferably 1.5 to 5.5 g/cm$^3$, further preferably 1.8 to 4.5 g/cm$^3$. The tap density indicates a value obtained by a method using a tap density measurement apparatus (manufactured by Kuramochi Scientific Instruments), in which 10 g of a sample is precisely weighed and placed in a 10 mL settling tube and subjected to 400-time tapping to calculate a tap density. The metal particle of the present invention is a non-nucleated, substantially true spherical porous material having continuous open pores and therefore has a small tap density, as compared to a metal particle having no void portion therein and having the same diameter as that of the metal particle of the present invention. In contrast to a metal particle having dendritic portions formed from needle-like crystals which have thinly grown, the metal particle of the present invention has uniform and dense dendritic portions and therefore has a larger tap density than that of the metal particle having dendritic portions formed from needle-like crystals which have thinly grown. The metal particle of the present invention has an appropriate tap density and hence, when used in a conductive composition, such as a conductive paste, the metal particle of the present invention exhibits satisfactory conduction properties even at a small content, as compared to the metal particle having no void therein and having the same diameter as that of the metal particle of the present invention.

The metal particle of the present invention preferably has a specific surface area of 0.25 to 8 m$^2$/g, more preferably 0.5 to 7 m$^2$/g, further preferably 2 to 6 m$^2$/g, as measured by a BET method. When the specific surface area of the metal particle of the present invention as measured by a BET method is within the above range, the metal particle advantageously exhibits excellent dispersibility upon being dispersed in a resin.

In the metal particle of the present invention, the value K determined from a specific surface area SS and a specific surface area BS and represented by the general formula (2) below preferably satisfies the relationship: $3 \leq K \leq 72$, more preferably $3 \leq K \leq 15$, wherein the specific surface area SS is represented by the formula (1) below wherein particle diameter d is a volume cumulative particle diameter $D_{50}$ as measured by a particle size distribution measurement method using image analysis and ρ is a theoretical density of the metal particle, and the specific surface area BS is a specific surface area as measured by a BEE method.

$$SS = 6/\rho d \quad (1)$$

$$(SS/BS) \times 100 = K \quad (2)$$

When value K represented by formula (2) above is within the above range, the metal particle advantageously exhibits excellent dispersibility upon being dispersed in a resin.

Figure 8:
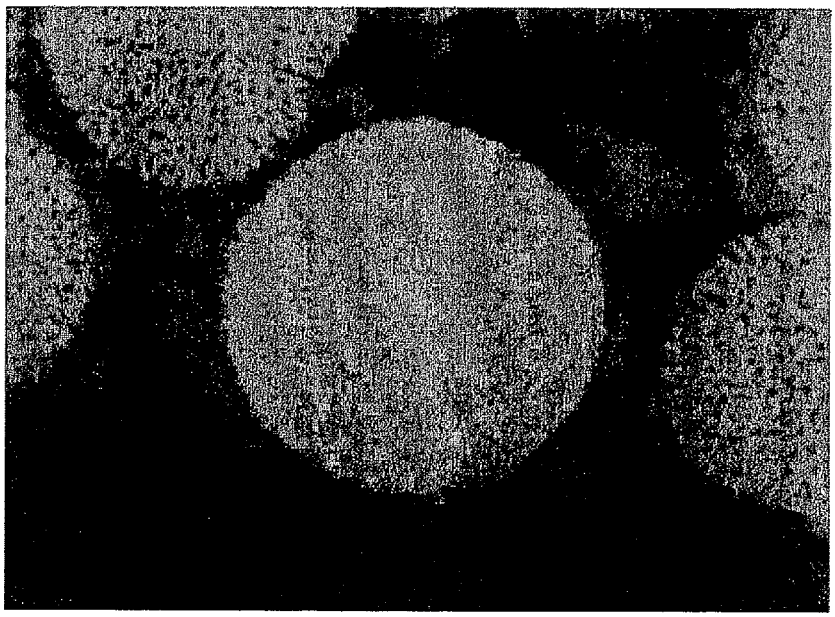
FIG. 8 A SEM photomicrograph of the cross-section of the metal (silver) particle of the present invention, magnified 20,000 times, showing the region SA of void portions obtained by image processing.

In the metal particle of the present invention, the region SA of void portions obtained by subjecting the image of the cross-section of the metal particle taken by means of a scanning electron microscope, magnified 20,000 times, to image processing preferably satisfies the relationship: $20 \leq SA \leq 40$. The region SA of void portions indicates a value determined by subjecting the image of the cross-section of the metal particle taken by means of a scanning electron microscope, magnified 20,000 times, to analysis using an image analysis software (trade name: "WinROOF", manufactured by Mitani Corporation) to measure void portions and a portion other than the void portions. FIG. 8 shows an image obtained by subjecting the image of the cross-section of the metal (silver) particle taken by means of a scanning electron microscope, magnified 20,000 times, to image processing, in which the colored area is the region SA of void portions and the white area is the portion other than the voids.

The metal particle of the present invention has a number of fine continuous open pores, and the continuous open pores are formed by spaces between the dendritic portions formed from dendritic crystals which have grown outward from the center, and thus a number of continuous open pores outward from the center are formed uniformly inside of the metal particle.

The metal particle of the present invention is preferably a metal particle selected from the group consisting of silver, copper, gold, nickel, and palladium. Especially preferred is silver or copper.

Next, an embodiment of the method for producing a metal particle of the present invention is described.

The method for producing a metal particle of the present invention comprises the steps of: mixing a metal salt and a polycarboxylic acid in a liquid phase; adding a reducing agent to the resultant mixture to deposit metal particles; and drying the deposited metal particles.

The temperature for the step for mixing a metal salt and a polycarboxylic acid in a liquid phase is preferably 10 to 30° C., more preferably 15 to 25° C. With respect to the time for mixing a metal salt and a polycarboxylic acid in a liquid phase, the metal salt and polycarboxylic acid may be uniformly mixed with each other, and the reaction time is not particularly limited, but is preferably about one minute to one hour, more preferably about 5 to 40 minutes.

The temperature for the step for adding a reducing agent to the above-obtained mixture to deposit metal particles is preferably 10 to 30° C., more preferably 15 to 25° C. With respect to the time for adding a reducing agent to the mixture, there is no particular limitation, but it is preferred that the reducing agent is added at once to the mixture of the metal salt and the polycarboxylic acid in a liquid phase while agitating the mixture. With respect to the time for agitating the mixture after adding the reducing agent, there is no particular limitation, but it is preferred that after completion of a foaming phenomenon accompanying the reduction reaction, the agitation is continued for about 3 minutes to one hour. The agitation is stopped, and the resultant mixture is allowed to stand, so that the deposited metal particles settle.

It is preferred that the deposited metal particles are collected by filtration and then dried. With respect to the drying temperature, there is no particular limitation, but the drying temperature is preferably 0 to 80° C., more preferably 10 to 60° C. The drying time varies depending on the drying temperature and is not particularly limited, but is preferably 1 to 20 hours, more preferably 3 to 18 hours.

The metal constituting the metal salt is a metal selected from the group consisting of silver, copper, gold, nickel, and palladium. By using the above metal, a metal particle having the characteristic features of the present invention can be obtained. The metal salt is preferably selected from the group consisting of a nitrate, a sulfate, a carbonate, and a chloride, more preferably a nitrate. Specifically, the metal salt is preferably selected from the group consisting of silver nitrate, copper nitrate, gold nitrate, nickel nitrate, palladium nitrate, silver sulfate, copper sulfate, gold sulfate, nickel sulfate, palladium sulfate, silver carbonate, copper carbonate, nickel carbonate, silver chloride, copper chloride, gold chloride, nickel chloride, and palladium chloride. The metal salt is more preferably silver nitrate copper nitrate, gold nitrate, nickel nitrate, or palladium nitrate, further preferably silver nitrate, copper nitrate, or gold nitrate.

With respect to the polycarboxylic acid, there is no particular limitation, and examples include aliphatic polycarboxylic acids, such as dicarboxylic acids and oxypolycarboxylic acids. Examples of dicarboxylic acids include malonic acid, succinic acid, maleic acid, and fumaric acid, and examples of polycarboxylic acids include oxydicarboxylic acids, such as tartaric acid and malic acid, and oxytricarboxylic acids, such as citric acid. Of these, preferred is at least one polycarboxylic acid selected from the group consisting of citric acid, malic acid, maleic acid, and malonic acid, and more preferred is citric acid, malic acid, or maleic acid. The polycarboxylic acids may be used individually or in combination.

The liquid phase in which the metal salt and the polycarboxylic acid are mixed with each other is a solvent capable of dissolving therein both the metal salt and the polycarboxylic acid, preferably pure water or ion-exchanged water.

The reducing agent is preferably ascorbic acid or an isomer thereof. Examples of isomers of ascorbic acid include L-ascorbic acid and isoascorbic acid. With respect to the reducing agent, ascorbic acid and the isomers thereof may be used individually or in combination.

It is preferred that the metal salt, the polycarboxylic acid, and the reducing agent are individually dissolved in pure water or ion-exchanged water and used in the form of an aqueous solution. The aqueous metal salt solution preferably has a concentration of 3 to 20 mol %/L. The aqueous polycarboxylic acid solution preferably has a concentration of 0.7 to 40 mol %/L. The aqueous reducing agent solution preferably has a concentration of 3 to 10 mol %/L.

When the concentrations of the aqueous metal salt solution, aqueous polycarboxylic acid solution, and aqueous reducing agent solution fall in the above-mentioned respective ranges, a metal particle which is a non-nucleated, spherical porous material having continuous open pores can be obtained without adding a nucleating agent, and thus there can be obtained a metal particle formed from dendritic crystals which have grown uniformly outward from the center.

The amounts of the metal salt, polycarboxylic acid, and reducing agent incorporated (in terms of a solids content) vary depending on their respective concentrations. For example it is preferred that, relative to 100 parts by mass of the metal salt, 10 to 100 parts by mass of the polycarboxylic acid is incorporated. Further, for example, it is preferred that, relative to 100 parts by mass of the metal salt, 60 to 600 parts by mass of the reducing agent is incorporated. Further, it is preferred that the amount of the metal salt incorporated is 10 to 60%, by mass, the amount of the polycarboxylic acid incorporated is 10 to 40% by mass, and the amount of the reducing agent incorporated is 30 to 80% by mass, based on the total mass of the metal salt, the polycarboxylic acid, and the reducing agent (100% by mass) (in terms of a solids content).

Further, in the method for producing a metal particle of the present invention, if necessary, an additive may be added.

Examples of additives include cationic dispersants, such as higher alkylmonoamine salts, alkyldiamine salts, and quaternary ammonium salts; anionic dispersants, such as carboxylic acid salts, sulfate salts, and phosphate salts; and fatty acids, such as Laurie acid, stearic acid, and oleic acid, but the additive is not particularly limited to these.

Figure 9:
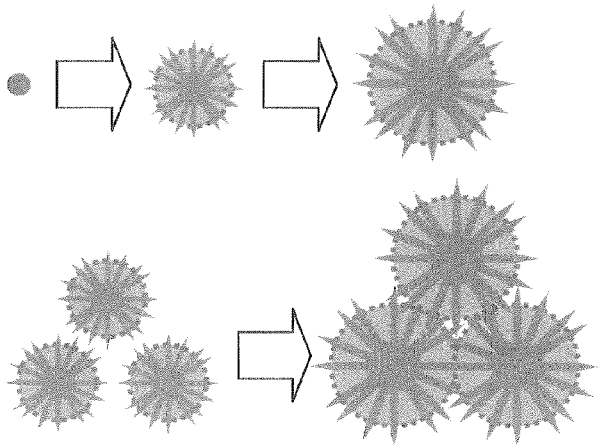
FIG. 9 A diagrammatic view showing the growth of a metal (silver) particle produced by the method of the present invention.
Figure 10:
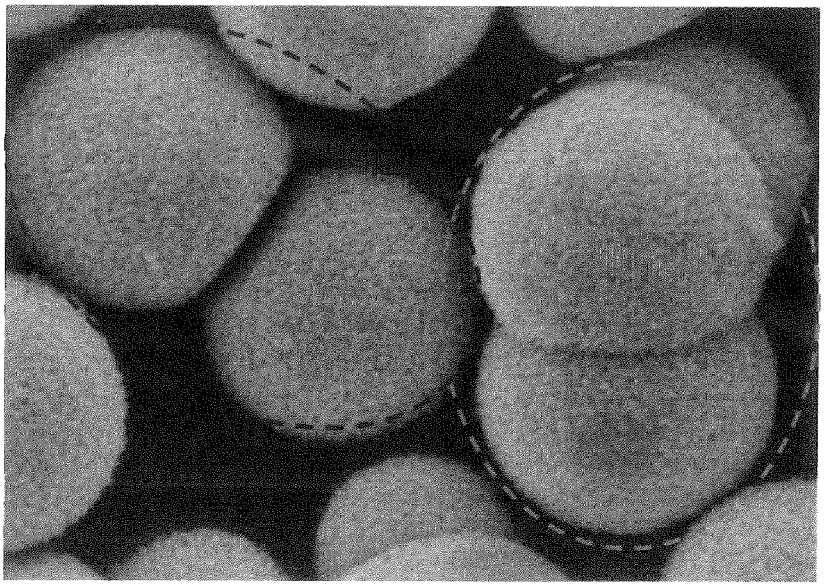
FIG. 10 A SEM photomicrograph enlarged view of the metal (silver) particle of the present invention magnified 5,000 times.
Figure 11:
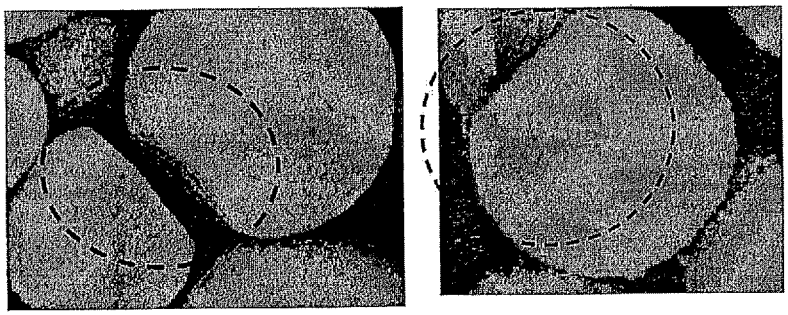
FIG. 11 A SEM photomicrograph enlarged view of the metal (silver) particle of the present invention magnified 5,000 times.

FIG. 9 is a diagrammatic view showing the growth of a metal particle produced by the method of the present invention. FIGS. 10 and 11 are SEM photomicrograph enlarged views of the metal particle of the present invention magnified 5,000 times.

As shown in FIG. 9, in the metal particle produced by the method of the present invention, there is no need to separately add a nucleating agent, and a reducing agent is added to a mixture containing a metal salt and a polycarboxylic acid to deposit metal particles in the solution, and then dendritic crystals grow uniformly outward from the deposited metal as a center. The crystals radially grow outward from the center so that the resultant metal particle has a fine uneven structure in the spherical surface. As shown in FIGS. 10 and 11, the ends of the dendritic portions of the metal particles, each of which is a non-nucleated, spherical porous material having continuous open pores, do not tangle, and further the metal particles easily separate from each other at the boundaries between the adjacent metal particles. Therefore, the metal particle of the present invention is unlikely to suffer strong bonding or aggregation of the metal particles and exhibits excellent dispersibility. Further, the ends of the dendritic portions suffer no breakage when dispersed in a medium, such as a resin, and it is expected that when the metal particle is dispersed in a medium, such as a resin, to produce, e.g., a conductive paste, it is possible to easily control the specific gravity or resistance. Moreover, the metal particle obtained by the method of the present invention has a fine uneven structure formed from dendritic portions in the spherical surface of the metal particle which is substantially true spherical, and therefore is expected to be fused at a relatively low temperature and exhibit excellent conduction properties.

Further, the present invention is a conductive composition comprising the metal particle which is a non-nucleated, spherical porous material having continuous open pores, and a resin, a conductor comprising a cured product obtained by curing the conductive composition, and an electronic part having the conductor.

The resin contained in the conductive composition is preferably a thermoplastic resin and/or a thermosetting resin. Examples of thermoplastic resins include an acrylic resin, ethyl cellulose, a polyester, a polysulfone, a phenoxy resin, and a polyimide. Preferred examples of thermosetting resins include amino resins, such as an urea resin, a melamine resin, and a guanamine resin; bisphenol A, bisphenol F, phenolic novolak, or alicyclic epoxy resins; oxetane resins; resol or novolak phenolic resins; and silicone-modified organic resins, such as silicone epoxy and silicone polyester. These resins may be used individually or in combination.

In the conductive composition, the metal particle:resin weight ratio is preferably 90:10 to 70:30. When the metal particle:resin weight ratio is within the above range, a metal film, which is obtained by applying the conductive composition to a substrate to form a film, and heating the formed film, can maintain a desired specific resistance.

Further, in the present invention, by virtue of the method in which a metal salt and a polycarboxylic acid are mixed in a liquid phase to effect a reaction, and then a reducing agent is added to the resultant mixture, the obtained metal particle has dendritic portions formed from crystals which have grown radially outward from the center without requiring a nucleating agent so that the metal particle has a fine uneven structure in the spherical surface. Therefore, the metal particle is unlikely to suffer bonding or aggregation of the metal particles, and the metal particle is easily fused at a relatively low temperature (for example, at 120 to 200° C.), and, even when the metal particle:resin weight ratio is 70:30, that is, the metal particle content is relatively small, excellent specific resistance can be maintained.

The conductive composition of the present invention can further comprise a solvent, and examples of solvents include aromatic hydrocarbons, such as toluene and xylene; ketones, such as methyl ethyl ketone, methyl isobutyl ketone, and cyclohexanone; ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, and esters thereof, such as acetic esters; and terpineol. It is preferred that, relative to 100 parts by mass of the total of the metal particle and the resin, 2 to 10 parts by mass of the solvent is incorporated.

The conductive composition of the present invention can further comprise at least one member selected from the group consisting of an inorganic pigment, an organic pigment, a silane coupling agent, a leveling agent, a thixotropic agent, and an anti-foaming agent.

The conductive composition of the present invention can be produced by charging the metal particle which is a non-nucleated, spherical porous material having continuous open pores, a resin, and other components into a mixing machine, such as a planetary stirring machine, a dissolver, a bead mill, a Raikai mixer, a three-roll mill, a rotary mixer, or a twin-screw mixer, and mixing them with one another. Thus, the conductive composition having an apparent viscosity suitable for screen printing, dipping, or another desired film forming method can be prepared.

The conductive composition of the present invention is used as a conductive paste, and applied to a support of, e.g., polyethylene terephthalate (PET) or indium tin oxide (ITO) by, e.g., a printing or coating method to form a film, and the formed film is cured at, for example, 150° C., obtaining a conductor comprising the resultant cured product. The conductor comprising the cured product preferably has a specific resistance of $35\times10^{-4}$ Ω·cm or less. The temperature for heating the conductive composition varies depending on the type of the resin constituting the conductive composition and is not particularly limited. When the resin is a thermoplastic resin, the conductive composition is preferably heated to 60 to 350° C., more preferably 80 to 300° C., and, when the resin is a thermosetting resin, the conductive composition is preferably heated to 60 to 350° C., more preferably 80 to 300° C.

As described above, the conductive composition of the present invention contains the metal particle which is a non-nucleated, spherical porous material having continuous open pores, and therefore the metal particle is fused at a relatively low temperature (for example, at 120 to 200° C.), so that a conductor comprising a cured product in the form of a thin film having a uniform thickness of about 25 μm and having excellent conduction properties can be formed.

The conductive composition of the present invention can be effectively formed into a conductor, such as an electronic circuit or an electrode, particularly a patterned conductor on the surface of a substrate. Further, the conductive composition of the present invention can be advantageously used as a conductive paste for plating primary coat, resistance, or electrode, a semiconductor sealing agent, or a conductive adhesive, such as a die attach adhesive.

The conductor comprising a cured product obtained by curing the conductive composition of the present invention is useful as an electronic part for a chip capacitor, an end face under electrode for chip resistance, a variable resistor, or a film substrate circuit.

EXAMPLES

Hereinbelow, the present invention will be described in more detail with reference to the following Examples, which should not be construed as limiting the scope of the present invention.

Example 1

10 kg of an aqueous silver nitrate solution (concentration: 10 mol %/L), 4 kg of an aqueous citric acid solution (concentration: 10 mol %/L), and 20 kg of pure water at 25° C. were individually weighed, and then placed in a 50 liter (L) stainless steel tank and agitated using an agitator (manufactured by Shimazaki Mixing Engineering Co., Ltd.; trade name: JET TYPE AJITER) at room temperature (25±10° C.) for 30 minutes to prepare a mixture of silver nitrate and citric acid.

Then, 17 kg of an aqueous ascorbic acid solution (aqueous L-ascorbic acid solution; concentration: 5 mol %/L) and 300 kg of pure water at 25° C. were individually weighed, and then placed in a 450 L stainless steel reaction tank and agitated using an agitator (manufactured by Shimazaki Mixing Engineering Co., Ltd.; trade name: JET TYPE MITER) at room temperature (25±10° C.) for 30 minutes to prepare an aqueous ascorbic acid solution.

Then, using an agitator having four stainless steel blades having a diameter of 600 mm (500 rpm), the mixture of silver nitrate and citric acid was poured at once into the prepared aqueous ascorbic acid solution to mix the mixture of silver nitrate and citric acid and the aqueous ascorbic acid solution with each other.

The aqueous ascorbic acid solution was added to the mixture of silver nitrate and citric acid and then, after several seconds, a reduction reaction was started, and, after a foaming phenomenon accompanying the reduction reaction was terminated, the agitation was continued for 30 minutes, and then the agitation was stopped. The mixture containing silver nitrate, citric acid, and ascorbic acid obtained after the reduction reaction had a pH of 2.

The resultant reaction mixture was allowed to stand, and then the supernatant was removed, and the settling silver particles were collected by filtration using a Nutsche, and the collected silver particles were spread over a stainless steel vat, and dried in a dryer at 60'C for 15 hours. After drying, silver particles having a specific surface area of 3.2 $m^2/g$, as measured by a BET method, shown in SEM photomicrographs of FIGS. 1 to 8, 10, and 11 were obtained. The SA value was 30, which was determined by subjecting the image of the cross-section of the silver particle taken by means of a SEM, magnified 20,000 times, to image processing using an image analysis software (trade name: WinROOF, manufactured by Mitani Corporation). As shown in FIG. 8, in the image obtained by subjecting the image of the cross-section of the silver particle taken by means of a scanning electron microscope, magnified 20,000 times, to image processing, the colored area is the region SA of void portions and the white area is the portion other than the voids.

As shown in FIGS. 1 to 8, 10, and 11, the silver particle in Example 1 is a non-nucleated, spherical porous material having continuous open pores, and has dendritic portions formed from crystals which have grown uniformly outward from the center so that the metal particle has a fine uneven structure in the spherical surface, and therefore is unlikely to suffer bonding or aggregation of the metal particles.

Comparative Example 1

6 L of an aqueous silver nitrate solution (concentration: 0.15 mol/L) and 200 ml of aqueous ammonia (concentration: 25 wt %) were mixed with each other to effect a reaction, obtaining an aqueous solution of a silver amine complex. To the obtained aqueous solution was added 20 g of hydrated hydrazine (concentration: 80 wt %) as a reducing agent to effect a reduction, depositing silver particles, and the silver particles were subjected to filtration, washing, and drying to obtain a spherical silver powder. The mixture containing the silver amine complex and hydrazine obtained after the reduction reaction had a pH of 2.

Figure 12:
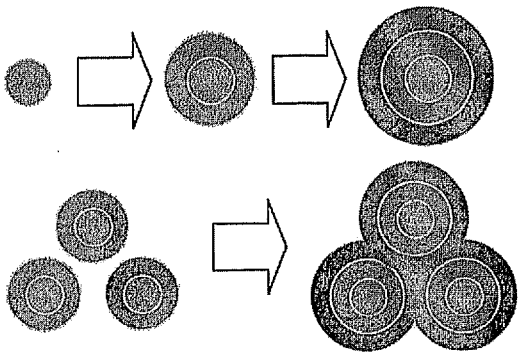
FIG. 12 A diagrammatic view showing the growth of a metal (silver) particle produced by the method in Comparative Example 1.
Figure 13:
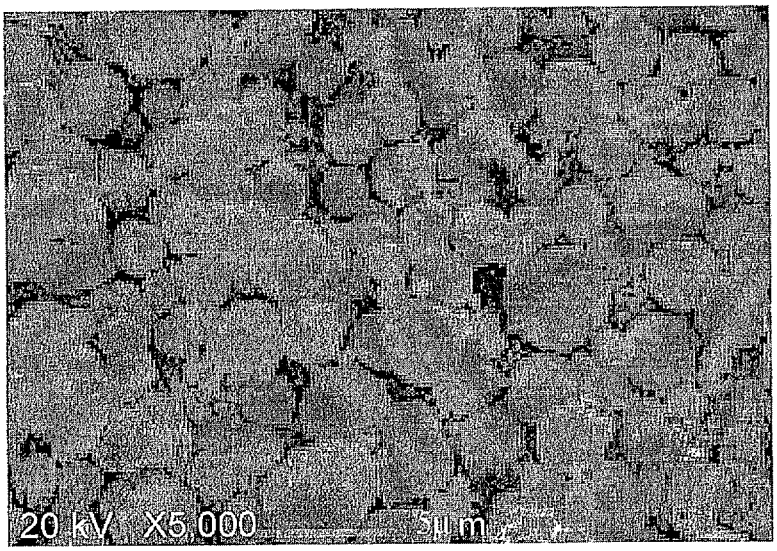
FIG. 13 A SEM photomicrograph of the metal (silver) particle in Comparative Example 1, magnified 5,000 times.

FIG. 12 is a diagrammatic view showing the expected growth of a metal particle produced by the conventional method in Comparative Example 1. FIG. 13 is a SEM photomicrograph of the silver particle in Comparative Example 1 magnified 5,000 times.

As shown in FIG. 12, in the metal particle produced by the conventional method, no dendrite grows, but crystals grow thick so that layers of them are stacked on one another. Therefore, as shown in FIG. 13, the silver particle in Comparative Example 1 has dispersion in the particle diameter, and it is likely that the silver particles are strongly fused together at their surfaces, causing aggregation of the particles. In the silver particle in Comparative Example 1, no dendrite grows and there is almost no void in the metal particle, and therefore an SA value could not be measured.

Comparative Example 2

10 kg of an aqueous silver nitrate solution (concentration: 10 mol %/L) and 20 kg of pure water at 25° C. were weighed, and then placed in a 50 L stainless steel tank and agitated using an agitator (manufactured by Shimazaki Mixing Engineering Co., Ltd.; trade name: JET TYPE AJITER) at room temperature (25±10° C.) for 30 minutes.

Then, 17 kg of an aqueous ascorbic acid solution (aqueous L-ascorbic acid solution; concentration: 5 mol %/L) and 300 kg of pure water at 25° C. were individually weighed, and then placed in a 450 L stainless steel reaction tank and agitated using an agitator (manufactured by Shimazaki Mixing Engineering Co., Ltd.; trade name: JET TYPE AJITER) at room temperature (25±10° C.) for 30 minutes to prepare an aqueous ascorbic acid solution.

Then, using an agitator having four stainless steel blades having a diameter of 600 mm (manufactured by Shimazaki Mixing Engineering Co., Ltd.; trade name: JET TYPE AJITER) at 500 rpm, the aqueous solution of silver nitrate dissolved in pure water was poured at once into the prepared aqueous ascorbic acid solution to mix the aqueous silver nitrate solution and the aqueous ascorbic acid solution with each other.

The aqueous ascorbic acid solution was added and then, after several seconds, a reduction reaction was started, and, after a foaming phenomenon accompanying the reduction reaction was terminated, the agitation was continued for 30 minutes, and then the agitation was stopped. The mixture containing silver nitrate and ascorbic acid obtained after the reduction reaction had a pH of 2.

The resultant reaction mixture was allowed to stand, and then the supernatant was removed, and the settling silver particles were collected by filtration using a Nutsche, and the collected silver particles were spread over a stainless steel vat, and dried in a dryer at 60° C. for 15 hours. In this instance, the obtained silver particle had a dendritic form as shown in FIG. 14.

Figure 14:
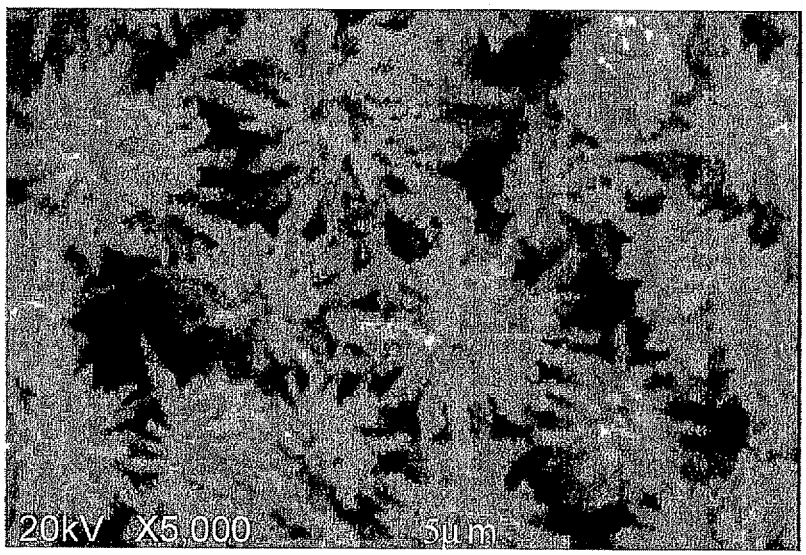
FIG. 14 A SEM photomicrograph of the metal (silver) particle in Comparative Example 2, magnified 5,000 times.

FIG. 14 is a SEM photomicrograph of the silver particle in Comparative Example 2 magnified 5,000 times. As seen in FIG. 14, the silver particle produced without adding a polycarboxylic acid has dendritic portions formed from pointed needle-like crystals which have grown outward from the center in a relatively sparse state, and therefore the pointed needle-like dendritic portions are likely to tangle, causing aggregation of the particles. Further, it is expected that the pointed needle-like portions are likely to be broken upon mixing into a resin, and that when the silver particle in Comparative Example 2 is used in a conductive paste, a uniform metal film cannot be formed from the paste at a relatively low temperature and satisfactory conduction properties cannot be obtained, making it difficult to control the specific gravity or resistance.

With respect to the silver particles in Example 1 and Comparative Examples 1 and 2, the following measurements were performed. The results are shown in Table 1.

Specific surface area as measured by a BET method

Tap density determined by a method using a tap density measurement apparatus (manufactured by Kuramochi Scientific Instruments), in which 10 g of a sample is precisely weighed and placed in a 10 mL settling tube and subjected to 400-time tapping to calculate a tap density.

Volume cumulative particle diameters $D_{10}$, $D_{50}$, $D_{90}$ as measured by a particle size distribution measurement method using image analysis (particle size distribution image analysis system, trade name: Mac-VIEW ver 1.00, manufactured by Mountech Co., Ltd.)

Particle size distributions $D_{90}/D_{50}$, $D_{50}/D_{10}$

SA Value measured by subjecting the image of the cross-section of the silver particle taken by means of a SEM magnified 20,000 times to image processing using an image analysis software (trade name: WinROOF, manufactured by Mitani Corporation)

K Value determined from a specific surface area SS and a specific surface area BS and represented by the general formula (2) below, wherein the specific surface area SS is represented by the formula (1) below wherein particle diameter d is a volume cumulative particle diameter $D_{50}$ as measured by a particle size distribution measurement method using image analysis and ρ is a theoretical density of the metal particle, and the specific surface area BS is a specific surface area as measured by a BET method.

$$SS=6/\rho d \quad (1)$$

$$(SS/BS)\times 100=K \quad (2)$$

TABLE 1

| | Example 1 | Comparative Example 1 | Comparative Example 2 |
|---|---|---|---|
| Specific surface area ($m^2/g$) | 3.2 | 0.4 | 0.98 |
| Tap density ($g/cm^3$) | 2.82 | 3.39 | 0.92 |
| Volume cumulative particle diameter $D_{50}$ (μm) | 3.32 | 7.1 | 9.88 |
| Volume cumulative particle diameter $D_{90}$ (μm) | 4.29 | 15.09 | 15.3 |
| Volume cumulative particle diameter $D_{10}$ (μm) | 2.33 | 2.99 | 2.74 |
| Particle size distribution ($D_{90}/D_{50}$) | 1.29 | 2.13 | 1.55 |
| Particle size distribution ($D_{50}/D_{10}$) | 1.42 | 2.37 | 3.61 |
| K Value | 5.39 | 20.1 | 5.9 |

As can be seen from Table 1, the silver particle in Example 1 has a larger specific surface area than those of the metal particles in Comparative Examples 1 and 2. In addition, the silver particle in Example 1 has dendritic portions formed from crystals which have densely and uniformly grown, and therefore has a smaller tap density than that of the silver particle in Comparative Example 1, in which no dendrite grows, and has a larger tap density than that of the silver particle in Comparative Example 2, which is formed from needle-like crystals which have thinly grown to cause larger voids. Further, the silver particle in Example 1 has a specific surface area about three times that of the silver particle in Comparative Example 2, but has a K value almost equivalent to that of Comparative Example 2, wherein K value indicates a ratio of the specific surface area determined from particle diameter d and theoretical density ρ to the specific surface area as measured by a BET method. This value confirms that the silver particle in Example 1 has a large specific surface area as compared to the metal particle in Comparative Example 2 and the density is large relative to the specific surface area, and that the silver particle in Example 1 has dendritic portions formed from crystals which have densely and uniformly grown. Further, the silver particle in Example 1 has a sharp particle size distribution.

Figure 15:
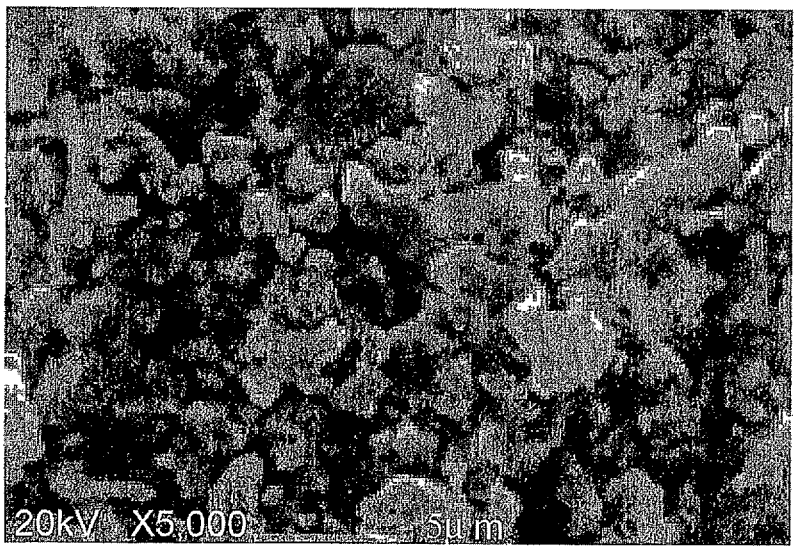
FIG. 15 A SEM photomicrograph of a flake-form silver particle magnified 5,000 times.

Next, using the silver particles in Example 1 and Comparative Example 1 and the flake-form silver particle (Comparative Example 3) and a phenoxy resin, conductive compositions were individually prepared so that the silver particle phenoxy resin weight ratio (silver particle/phenoxy resin) became 90/10, 80/20, 70/30, 60/40, or 50/50, and a specific resistance of each composition was measured by the method shown below. The flake-form silver particle used as Comparative Example 3 has an average particle diameter of 10 μm. The average particle diameter of the flake-form silver particle indicates an average diameter with respect to the flat surface of the particle. In Table 2, the indication "Not conductive" means that no electric conduction is made. FIG. 15 shows a SEM photomicrograph of the flake-form silver particle magnified 5,000 times.

[Specific Resistance]

Using a 250-mesh stainless steel screen, the conductive compositions using the silver particles in Example 1 and Comparative Examples 1 and 3 were individually subjected to 71 mm×1 mm zigzag pattern printing on a 20 mm square alumina substrate, and cured under heating conditions at 150° C. for 30 minutes. After curing, a resistance was measured by an LCR meter four-terminal method at a temperature of 20±3° C. and at a relative humidity of 50±15%. A specific resistance was determined from the specific resistance and the thickness of the cured film (thickness of the cured film: 30 μm). The results are shown in Table 2.

Figure 16:
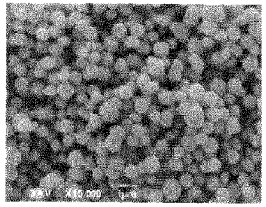
FIG. 16 Analysis values of the metal (silver) particles having different volume cumulative average particle diameters and SEM photomicrographs of these particles magnified 10,000 times, 5,000 times, 2,000 times, and 20,000 times.
Figure 16:
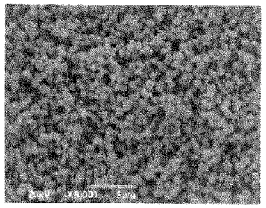
Figure 16:
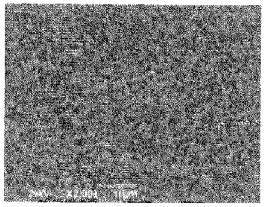
Figure 16:
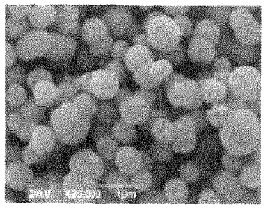
Figure 16:
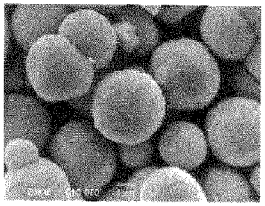
Figure 16:
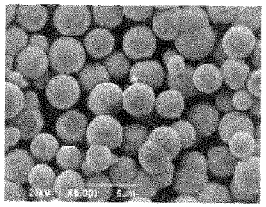
Figure 16:
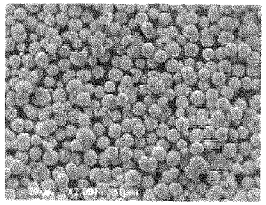
Figure 16:
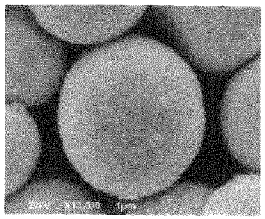
Figure 16:
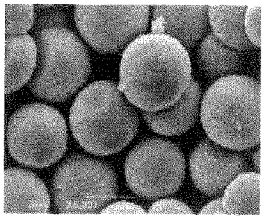
Figure 16:
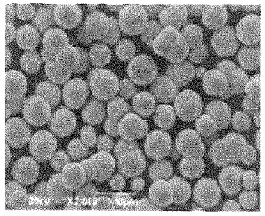

$D_{10}$, $D_{50}$, $D_{90}$ of the silver particles in Examples 2, 3, and 4 and SEM photomicrographs of the silver particles magnified 10,000 times, 5,000 times, 2,000 times, and 20,000 times are shown in FIG. 16.

Example 2

A silver particle having a volume cumulative particle diameter $D_{50}$ of 0.67 μm was obtained in substantially the same manner as in Example 1 except that the pH of the mixture containing silver nitrate, citric acid, and ascorbic acid obtained after the reduction reaction was adjusted to more than 3. SA value of the silver particle in Example 2 as measured in the same manner as in Example 1 was 20.

Example 3

A silver particle having a volume cumulative particle diameter $D_{50}$ of 3.32 mm was obtained in substantially the same manner as in Example 1 except that the pH of the mixture containing silver nitrate, citric acid, and ascorbic acid obtained after the reduction reaction was adjusted to more than 2 to 3 or less. The SA value of the silver particle in Example 3 which was measured in the same manner as in Example 1, was 28.

Example 4

A silver particle having a volume cumulative particle diameter $D_{50}$ of 7.97 mm was obtained in substantially the same manner as in Example 1 except that the pH of the mixture containing silver nitrate, citric acid, and ascorbic acid obtained after the reduction reaction was adjusted to 2 or less. SA value of the silver particle in Example 4 which was measured in the same manner as in Example 1, was 39.5.

TABLE 2

| | | Example 1 (Silver citrate powder) | | Comparative Example 1 (Spherical powder) | | Comparative Example 3 (Flake powder) | |
|---|---|---|---|---|---|---|---|
| | Silver/resin ratio (wt %) | Cured at 150° C. | Cured at 200° C. | Cured at 150° C. | Cured at 200° C. | Cured at 150° C. | Cured at 200° C. |
| Specific resistance ($\times 10^{-4}$ Ω · cm) | 90/10 | 6.81 | 4.15 | 1.15 | 0.79 | 0.35 | 0.39 |
| | 80/20 | 9.16 | 6.6 | 5.05 | 3.09 | 5.18 | 3.55 |
| | 70/30 | 24.51 | 20.45 | Not conductive | 159.8 | Not conductive | 54.1 |
| | 60/40 | Not conductive | Not conductive | Not conductive | Not conductive | Not conductive | Not conductive |
| | 50/50 | Not conductive | Not conductive | Not conductive | Not conductive | Not conductive | Not conductive |

As can be seen from Table 2, with respect to the conductive composition using the silver particle in Example 1, when the silver particle:phenoxy resin (silver particle:phenoxy resin) ratio is 70:30, that is, the silver particle weight ratio is relatively small, the conductive composition exhibits more excellent specific resistance than those of the conductive compositions using the silver particles in Comparative Examples 1 and 3, and a conductor comprising a cured product obtained by curing the conductive composition in Example 1 had a specific resistance of $24.51\times10^{-4}$ Ω·cm or less.

Further, silver particles having different volume cumulative particle diameters $D_{50}$ (Examples 2, 3, and 4) were prepared by the method shown below. With respect to the obtained silver particles in Examples 2, 3, and 4, a specific surface area, a tap density, a K value, and volume cumulative particle diameters $D_{10}$, $D_{50}$, $D_{90}$ were measured by the same methods as those in Example 1. The specific surface area, tap density. K value, and volume cumulative particle diameters As seen from FIG. 16, the silver particles in Examples 2 to 4, though they have different volume cumulative particle diameters $D_{50}$, are individually a non-nucleated, spherical porous material having continuous open pores and have dendritic portions formed from crystals which have radially grown outward from the center so that the metal particle has a fine uneven structure in the spherical surface. As seen from FIG. 16, in the silver particles in Examples 2 to 4, the ends of the dendritic portions do not tangle, and further the silver particles easily separate from each other at the boundaries between the adjacent silver particles. Therefore, the silver particles in Examples 2 to 4 are unlikely to suffer bonding or aggregation of the silver particles and exhibit excellent dispersibility.

INDUSTRIAL APPLICABILITY

The metal particle of the present invention is a metal particle which is a non-nucleated, spherical porous material having continuous open pores, and has dendritic portions formed from dendritic crystals which have radially grown uniformly outward from the center so that the metal particle has a fine uneven structure in the spherical surface. The metal particle of the present invention is advantageous not only in that the metal particle is unlikely to suffer bonding or aggregation of the metal particles and exhibits excellent dispersibility, but also in that the particle has a uniform average particle diameter and has an appropriate tap density and a large specific surface area, and further the density is large relative to the specific surface area, and thus the metal particle can be advantageously used in applications, such as a conductive paste, a sintering auxiliary, a semiconductor sealing agent, a conductive adhesive, a catalyst, and a medical product.

The invention claimed is:

1. A silver particle which is a non-nucleated, spherical porous material having continuous open pores and has:

a volume cumulative particle diameter $D_{50}$ of 0.5 to 9 μm as measured by a particle size distribution measurement method using image analysis;

a tap density of 1.8 to 4.5 g/cm$^3$;

a specific surface area of 2 to 6 m$^2$/g as measured by a BET method; and a value K of $3 \leq K \leq 15$, wherein the value K is determined from a specific surface area SS and a specific surface area BS, and is represented by the following formula (2), wherein the specific surface area SS is represented by the following formula (1), wherein d is a volume cumulative particle diameter $D_{50}$ as measured by a particle size distribution measurement method using image analysis and ρ is a theoretical density of the silver particle, and the specific surface area BS is a specific surface area as measured by a BET method:

$$SS=6/\rho d \quad (1)$$

$$(SS/BS)\times 100=K \quad (2).$$

2. The silver particle according to claim 1, wherein the region SA of void portions obtained by subjecting the image of the cross-section of the silver particle taken by means of a scanning electron microscope, magnified 20,000 times, to image processing satisfies the relationship: $20 \leq SA \leq 40$.

3. The silver particle according to claim 1, wherein, in an image of the silver particle taken by means of a scanning electron microscope, magnified 20,000 times, the morphology of the appearance of the silver particle has an aegagropila form.

4. The silver particle according to claim 1, wherein, in an image of the silver particle taken by means of a scanning electron microscope, magnified 10,000 times, the morphology of the cross-section of the silver particle has a non-nucleated coral form.

5. The silver particle according to claim 1, wherein the cross-sectional structure of the silver particle taken by means of a scanning electron microscope, magnified 20,000 times, has a structure shown in FIG. 1.

6. A conductive composition comprising the silver particle according to claim 1, and a resin.

7. The conductive composition according to claim 6, wherein the resin is a thermoplastic resin and/or a thermosetting resin.

8. A conductor comprising a cured product obtained by curing the conductive composition according to claim 6.

9. An electronic part comprising the conductor according to claim 8.

10. The silver particle of claim 1 obtained by a method comprising the steps of:

(a) mixing silver nitrate and citric acid in a liquid phase;

(b) adding ascorbic acid or an isomer thereof to the resultant mixture from step (a) to deposit silver particles without adding a nucleating agent;

(c) drying the deposited silver particles, wherein steps (a) and (b) are carried out at a temperature of 10 to 30° C., and step (c) is carried out at a temperature of 0 to 80° C.

* * * * *